US006118412A

United States Patent [19]

Chen

[11] Patent Number: 6,118,412

[45] Date of Patent: Sep. 12, 2000

[54] WAVEGUIDE POLARIZER AND ANTENNA ASSEMBLY

[75] Inventor: Ming Hui Chen, Taipei, China

[73] Assignee: Victory Industrial Corporation, China

[21] Appl. No.: 09/187,137

[22] Filed: Nov. 6, 1998

[51] Int. Cl.[7] ..... H01Q 19/00; H01P 1/17

[52] U.S. Cl. ..... 343/756; 333/137; 333/21 A; 343/786

[58] Field of Search ..... 333/125, 137, 333/21 A, 239; 343/756, 786

[56] References Cited

U.S. PATENT DOCUMENTS

| | | | |
|---|---|---|---|
| 3,955,202 | 5/1976 | Young | 343/756 |
| 3,958,193 | 5/1976 | Rootsey | 333/125 |
| 4,122,406 | 10/1978 | Salzberg | 333/113 |
| 4,395,685 | 7/1983 | Davies et al. | 333/125 |
| 4,658,258 | 4/1987 | Wilson | 343/786 |
| 5,266,911 | 11/1993 | Perpall et al. | 333/135 |
| 5,374,938 | 12/1994 | Hatazawa et al. | 343/756 |
| 5,614,916 | 3/1997 | Mizuguchi | 343/786 |
| 5,760,660 | 6/1998 | Nagatsu et al. | 333/21 A X |
| 5,852,390 | 12/1998 | Yoshimura | 333/21 A |
| 5,937,509 | 8/1999 | Tokuda et al. | 333/21 A X |

OTHER PUBLICATIONS

Chen, M.H., and Tsandoulas, G.N., "A Wide–Band Square–Waveguide Array Polarizer," *IEEE Transactions on Antennas and Propagation* (May 1973), AP–21(3):389–91.

*Primary Examiner*—Paul Gensler
*Attorney, Agent, or Firm*—Fliesler, Dubb, Meyer & Lovejoy LLP

[57] ABSTRACT

A waveguide antenna assembly includes a feedhorn having a cavity coupled to a waveguide polarizer. The waveguide polarizer includes a single aperture waveguide, septum-loaded waveguide, and a dual aperture waveguide coupled inline. The septum-loaded waveguide includes an internal septum and is formed from at least one internal wall having a varying thickness. The length of the circular feedhorn and the diameter of the feedhorn cavity can be adjusted with the length of the single aperture waveguide to maximize signal isolation between the orthogonal signal ports.

14 Claims, 8 Drawing Sheets

WAVEGUIDE POLARIZER AND ANTENNA ASSEMBLY

BACKGROUND OF THE INVENTION

The present invention relates to antenna systems and more particularly to a waveguide antenna assembly for transmitting and/or receiving circularly-polarized signals.

Within the field of waveguide antenna systems, dual waveguide polarizers are known to provide the capability of transmitting and /or receiving left hand circularly-polarized (LHCP) signals and right hand circularly-polarized (RHCP) signals over the same frequency band. The ability to communicate both signal types over the same frequency band effectively doubles the system's communication capability compared to a linear antenna system.

FIG. 1 illustrates one such waveguide polarizer 100 for transmitting and receiving orthogonal LHCP and RHCP signals as described in A Wide-Band Square-Waveguide Array Polarizer, IEEE Transactions on Antennas and Propagation, Vol. AP21, No. 3, May 1973. The waveguide polarizer 100 includes a single aperture waveguide 120, a septum-loaded waveguide 140, and a dual aperture waveguide 160 coupled inline. The single aperture waveguide 120 includes walls 102 which defines a waveguide cavity 122 for transmitting an outgoing or receiving an incoming signal. The septum-loaded waveguide 140 includes a septum 148, which may be stepped or tapered and which forms waveguide channels 144 and 146. The septum dimensions are typically based upon the center frequency of operation (or wavelength) and scaled to the dimensions needed. Typically, the septum 148 is designed as having a infinitesimally small thickness (usually about 1–2% of the wavelength at center frequency) and can deteriorate the polarizer's performance if it is fabricated too thickly. In the conventional polarizer of FIG. 1, the septum is 0.014λ thick to introduce only minimal error into the measured response.

The dual aperture waveguide 160 includes LHCP and RHCP signal ports 164 and 166 for sensing or launching the LHCP or RHCP signals, respectively, during reception or transmission. Probes may be located within these ports to facilitate sensing or exciting the LHCP and RHCP signals. A common wall 168 extends from septum 148 to separate the LHCP and RHCP signal ports 164 and 166. A feedhorn (not shown) is connected to the single aperture waveguide 120 for launching or receiving the LHCP or RHCP signals.

As known in the art, the dimensions of both the single aperture waveguide 122 and the interfacing circular feedhorn (not shown) are critical to provide a good impedance match at the polarizer/feedhorn interface and to ensure proper signal isolation between the orthogonal LHCP and RHCP signal ports. In conventional systems, such as those shown in U.S. Pat. No. 3,955,202 to Young, similar geometry feedhorns and polarizers are used, i.e., circular feedhorns are typically employed with circular polarizers and rectangular feedhorns with rectangular polarizers.

The above described polarizer/feedhorn assemblies suffer from several important disadvantages. Firstly, the conventional waveguide polarizer suffers from the disadvantage of extremely small and difficult to manufacture septum dimensions as the center frequency of operation increases beyond X-band (10 GHz). For instance, the conventional waveguide polarizer of FIG. 1 illustrates a septum 148 having a thickness of 0.014λ and a first step height of 0.080λ. Using this design, a waveguide polarizer operating in the Ka-band (18–20 GHz) would require a septum thickness of 0.039 mm and a first step height of 0.221 mm. Waveguide polarizers of these minute dimensions are exceedingly difficult and costly to manufacture and are extremely unreliable due to the fragility of their small components. As communication systems increase in operational frequency, these encumbrances become more even more pronounced.

Secondly, the prior art assemblies suffer from the limitation that the polarizer and feedhorn are of similar geometries, i.e. rectangular feedhorns matched to rectangular polarizers and circular feedhorn matched to circular polarizers. Rectangular waveguide polarizers are preferred over circular waveguide polarizers since rectangular polarizers are more easily matched to widely used rectangular waveguide systems. However, circular feedhorns are preferred since they exhibit less signal loss compared to rectangular feedhorns. Implementing a circular feedhorn with a rectangular waveguide polarizer could provide several advantages but a method teaching their combination has not been taught in the prior art.

What is needed is a new waveguide polarizer design which can operate at high frequencies but which can also be easily manufactured. Further needed is a waveguide assembly design and matching technique for interfacing a circular feedhorn with a rectangular polarizer assembly to provide high signal isolation between orthogonal signals.

SUMMARY OF THE INVENTION

The present invention provides a waveguide polarizer design and antenna system offering improved high frequency performance, easy manufacturability, and excellent orthogonal signal isolation. In one embodiment of the invention, a waveguide polarizer is described having a single aperture waveguide, a septum-loaded waveguide, and a dual aperture waveguide coupled inline. The dual aperture waveguide includes first and second orthogonal signal ports for sensing or launching the orthogonal signals. The septum-loaded waveguide includes a septum for separating the orthogonal signals and is formed from at least one internal wall having a varying thickness dimension. The varying thickness dimension of the waveguide's internal walls allows the polarizer to be manufactured using casting techniques instead of conventional numerically controlled machining, significantly reducing the fabrication cost.

In a second embodiment of the invention, a waveguide antenna assembly is described having a feedhorn and a waveguide polarizer. The feedhorn has a first port for transmitting and receiving signals and a cavity coupled to the waveguide polarizer. The polarizer includes a single aperture waveguide, a septum-loaded waveguide, and a dual aperture waveguide coupled inline. The single aperture waveguide is coupled to the feedhorn for receiving and/or transmitting orthogonal signals. The dual aperture waveguide includes first and second orthogonal signal ports for sensing or launching orthogonal signals. The septum-loaded waveguide includes a septum for separating the orthogonal signals and is formed from at least one internal wall having a varying thickness dimension. The varying thickness dimension of the septum allows the polarizer to be manufactured using casting techniques instead of conventional numerically controlled machining, significantly reducing the fabrication cost. The length of the feedhorn and the diameter of the feedhorn cavity can be adjusted with the length of the single aperture waveguide to optimize signal isolation between the orthogonal input/output ports.

The invention will be better understood by reference to the following detailed description in connection with the accompanying drawings.

DESCRIPTION OF THE SPECIFIC EMBODIMENTS

Figure 2A:
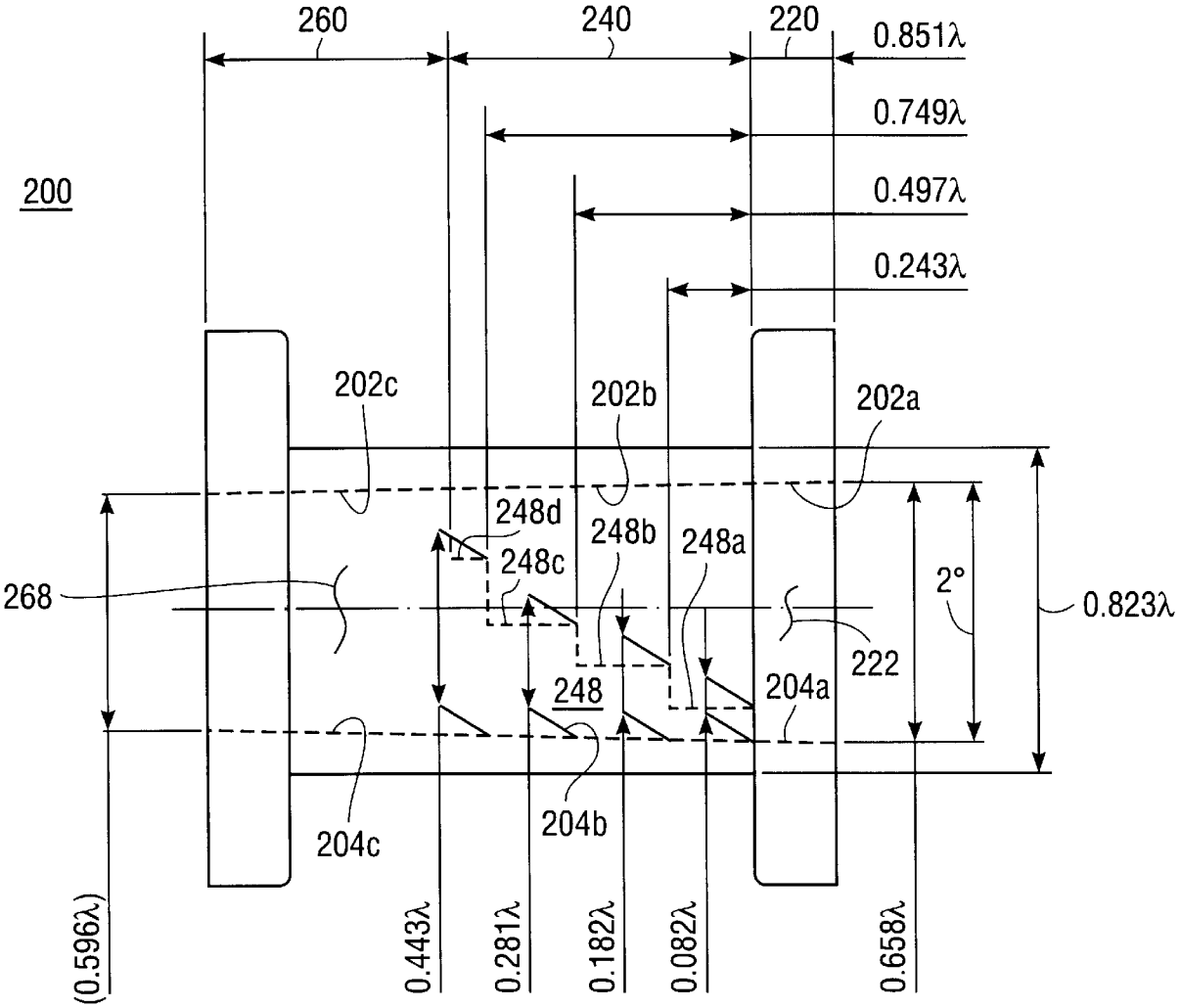
FIGS. 2A–D illustrate top, side, front, and back views, respectively, of a rectangular waveguide polarizer in accordance with one embodiment of the invention.

FIG. 2A illustrates a top view of a rectangular waveguide polarizer 200 for communicating LHCP and RHCP signals over the Ka-Band frequency range (18–20 GHz) (drawn substantially to scaled). Those of skill in the art will appreciate that with obvious modifications to the following description the invention may alternatively be realized in a circular waveguide embodiment or modified to operate over a different frequency range, and/or signal polarization.

The below-described waveguide polarizer further includes internal walls and a septum which have a tapered thickness. By tapering the thickness of the septum and internal walls, the waveguide polarizer can be fabricated more economically using casting techniques instead of machining each part which has been heretofore the norm in the industry. Moreover, by tapering the thickness of the septum, its structural durability the tapered thickness of the septum 248 also increases its structural durability.

The waveguide polarizer 200 includes a single aperture waveguide 220, a septum-loaded waveguide 240, and a dual aperture waveguide 260. The single aperture waveguide 220 includes internal top and bottom walls (not indicated) and side walls 202*a* and 204*a* which defines a waveguide cavity 222 for transmitting an outgoing or receiving an incoming signal. In the illustrated embodiment, the waveguide cavity 222 has a length of $L_1$ and a width of 0.658λ, where λ is the wavelength at the center frequency of operation.

The septum-loaded waveguide 240 includes internal side walls 202*b* and 204*b*, and a septum 248 extending vertically therebetween. Septum 248 includes first through fourth steps 248*a–d*, the first of which extends the least and is nearest to the single aperture waveguide. Each of the steps 248*a–d* has a length dimension (horizontally as shown) which extends substantially parallel to the axis of signal propagation, and a width dimension (vertically as shown) which extends substantially normal to the axis of signal propagation. In the illustrated embodiment, the length dimension of the first through fourth steps are 0.243λ, 0.497λ, 0.749λ, and 0.851λ, respectively, as measured from the beginning of the septum-loaded waveguide 240. The width of the first through fourth steps are 0.082λ0, 0.0182λ0, 0.281λ, and 0.443λ, respectively, as measured from internal side wall 204*b*. The septum-loaded waveguide 240 terminates at the point where the fourth step 248*d* of the septum 248 extends into the internal side wall 202*b*. The illustrated embodiment describes a four step design, although in alternative embodiments the septum may utilize a larger or smaller number of steps. Further alternatively, a vertically tapered septum or other known septum configuration may be used.

The dual aperture waveguide 260 includes internal side walls 202*c* and 204*c*, and first and second orthogonal signal ports 264 and 266 (described below) for sensing or launching the LHCP or RHCP signals, respectively, during reception or transmission. Probes may be located within first and second signal ports to facilitate sensing or exciting the LHCP and RHCP signals. A common wall 268 extends from septum 248 to separate first and second orthogonal signal ports 264 and 266. In the illustrated embodiment, each of the first and second signal ports 264 and 266 has a width dimension (vertically as shown) of 0.596λ.

As illustrated, internal side walls 202 and 204 have a varying thickness extending between the single aperture waveguide 220 and the dual aperture waveguide 260. Internal side walls 202 and 204 are tapered at approximately 2 degrees, and have a minimum thickness nearest to the single aperture waveguide 220 and a maximum thickness nearest to the dual aperture waveguide 260. In alternative embodiments, the magnitude, shape, and direction of the taper may be variations of those shown.

Figure 2B:
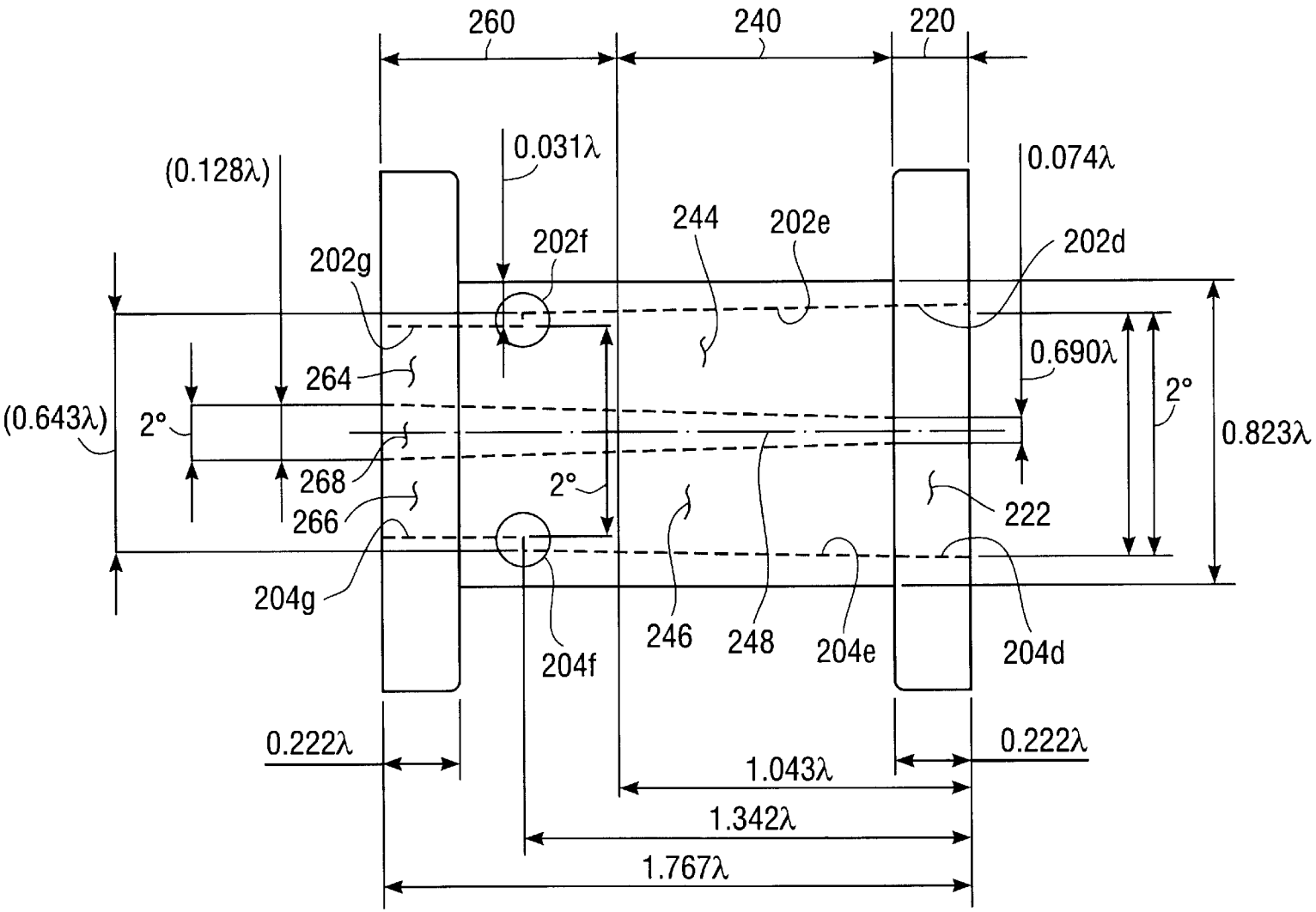

FIG. 2B illustrates a side view of the waveguide polarizer 200 having the aforementioned single aperture waveguide 220, septum-loaded waveguide 240, and dual aperture waveguide 260 (drawn substantially to scale). The single aperture waveguide 220 is includes top and bottom walls 202*d* and 204*d*, respectively, defining a height dimension of 0.690λ. The single aperture waveguide has a length $L_1$=0.222λ.

Figure 1:
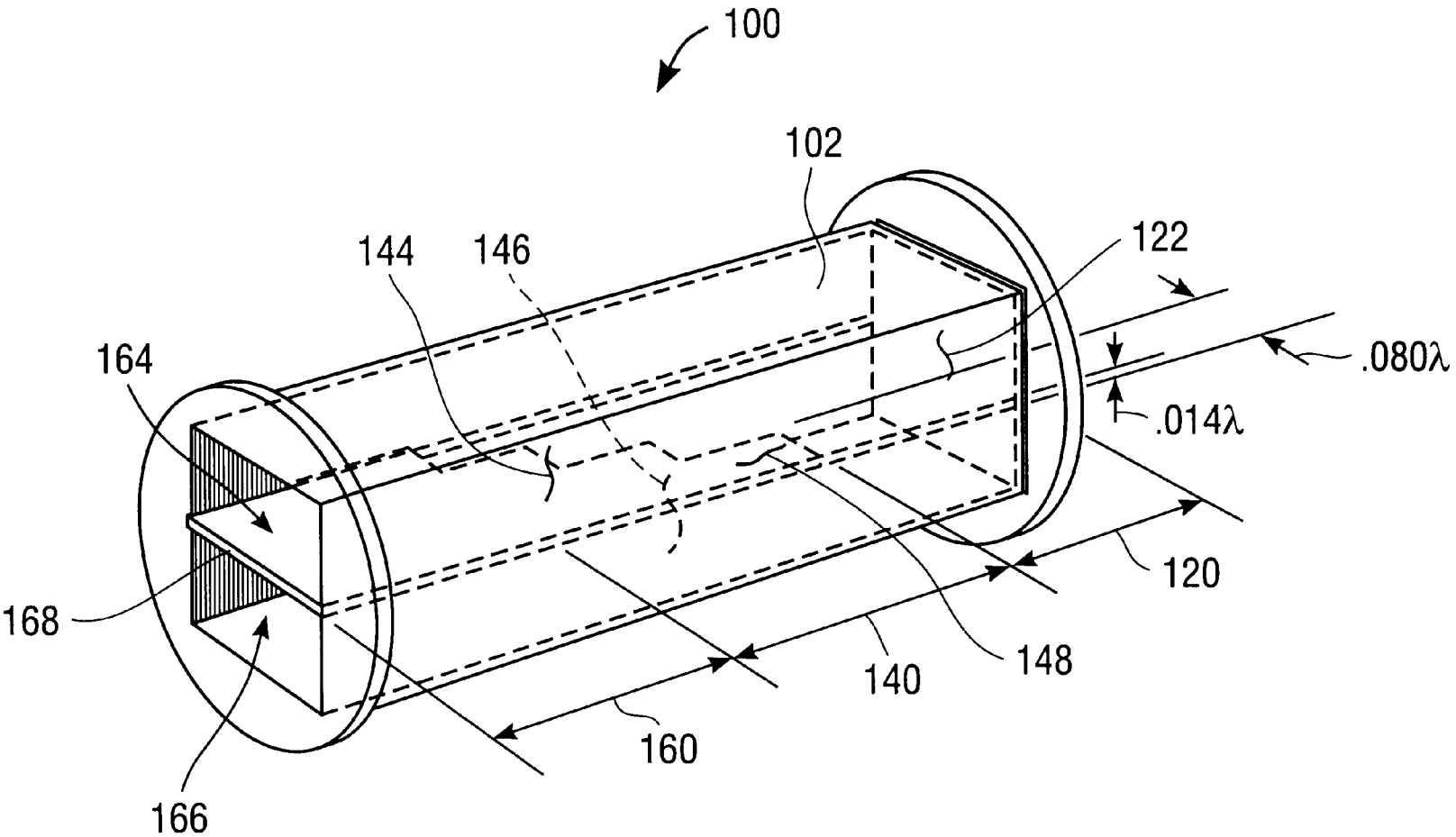
FIG. 1 (PRIOR ART)
FIG. 1 illustrates a conventional waveguide polarizer known in the art.

The septum-loaded waveguide 240 includes top and bottom walls 202*e* and 204*e*, respectively, and a septum 248 which extends longitudinally through the septum-loaded waveguide 240. In the illustrated embodiment, the septum has a minimal thickness of 0.074λ proximate to the single aperture waveguide 220 increasing as it extends toward the dual aperture waveguide 260. In comparison to the prior art septum thickness (0.014λ) of FIG. 1, the new septum 248 is more than five times as thick, the added thickness improving the septum's reliability.

Internal walls 202 and 204 and septum 248 defines first and second waveguide channels 244 and 246. First and second waveguide channels 244 and 246 are located such that each is in communication with the single aperture waveguide 220. First septum step 248*a* (FIG. 2A) is formed proximate to the single aperture waveguide 220. Fourth septum step 248*d* (FIG. 2A) is formed proximate to dual aperture waveguide 260 and extends into the plane of FIG. 2B, between side walls 202 and 204.

The dual aperture waveguide 260 includes top and bottom walls 202*g* and 204*g*, and a common wall 268 located therebetween which forms first and second orthogonal signal ports 264 and 266. In the illustrated embodiment, common wall 268 extends from the septum 248 and is 0.128λ thick. First and second signal ports 264 and 266 are located such that they are in communication with first and second waveguide channels 244 and 246.

The dual aperture waveguide 260 further includes first and second waveguide steps 202*f* and 204*f*. First and second waveguide steps 202*f* and 204*f* are implemented to compensate for the even-mode capacitive effect produced by the thickened septum 248. First and second waveguide steps are located 1.342λ away from the single waveguide aperture 220, and are 0.031λ in height.

In the illustrated embodiment, internal top and bottom walls 202 and 204 and septum 248 each have a varying thickness. Internal top and bottom walls 202 and 204 are tapered at approximately 2 degrees, having a minimum thickness nearest to the single aperture waveguide 220 and a maximum thickness nearest to the dual aperture waveguide

260. Septum 248 is also tapered at approximately 2 degrees and has a minimum thickness of 0.074λ nearest to the single aperture waveguide 220, extending into the dual aperture waveguide 260 to form the common wall 268 where the septum reaches its maximum thickness of 0.128λ. In alternative embodiments, the magnitude, shape, and direction of the taper may be variations of those shown.

Figure 2C:
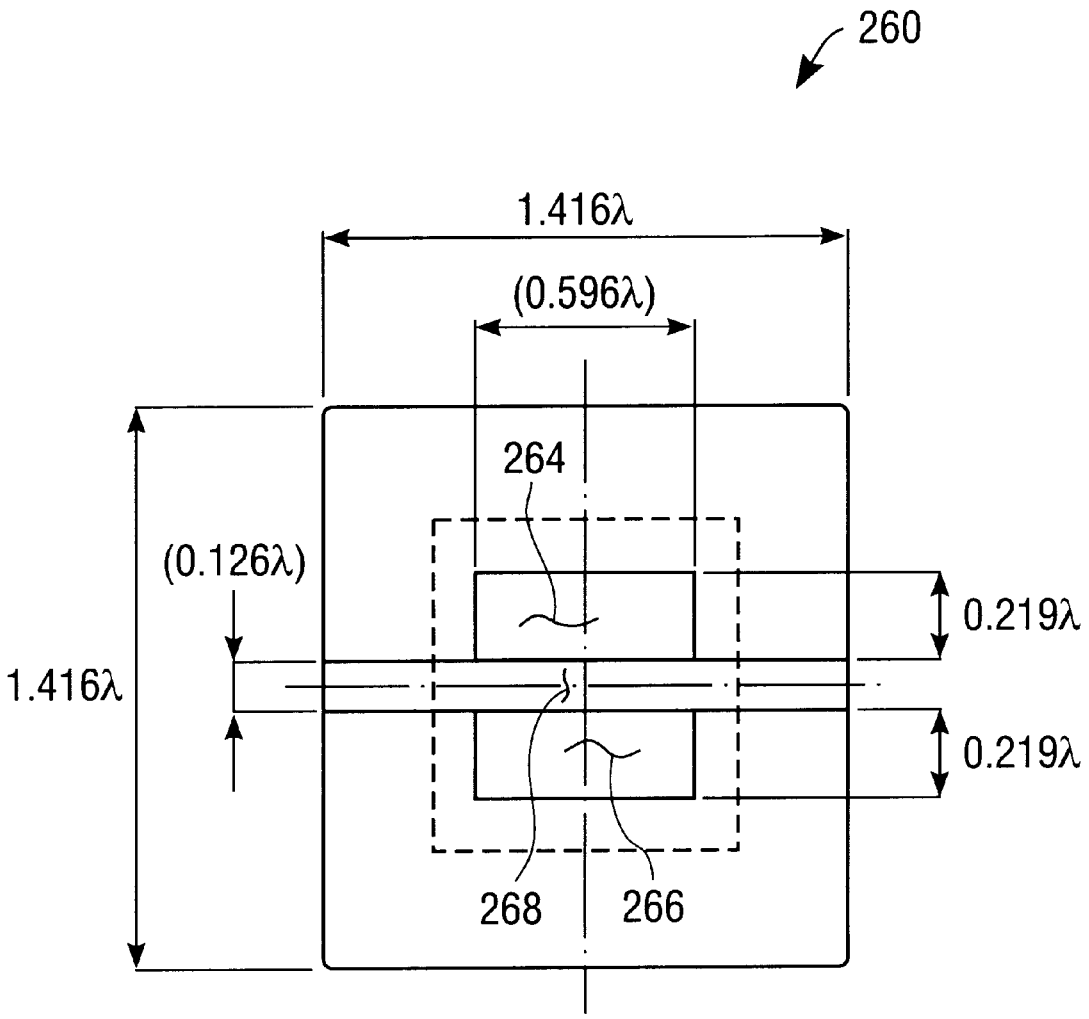
Figure 2D:
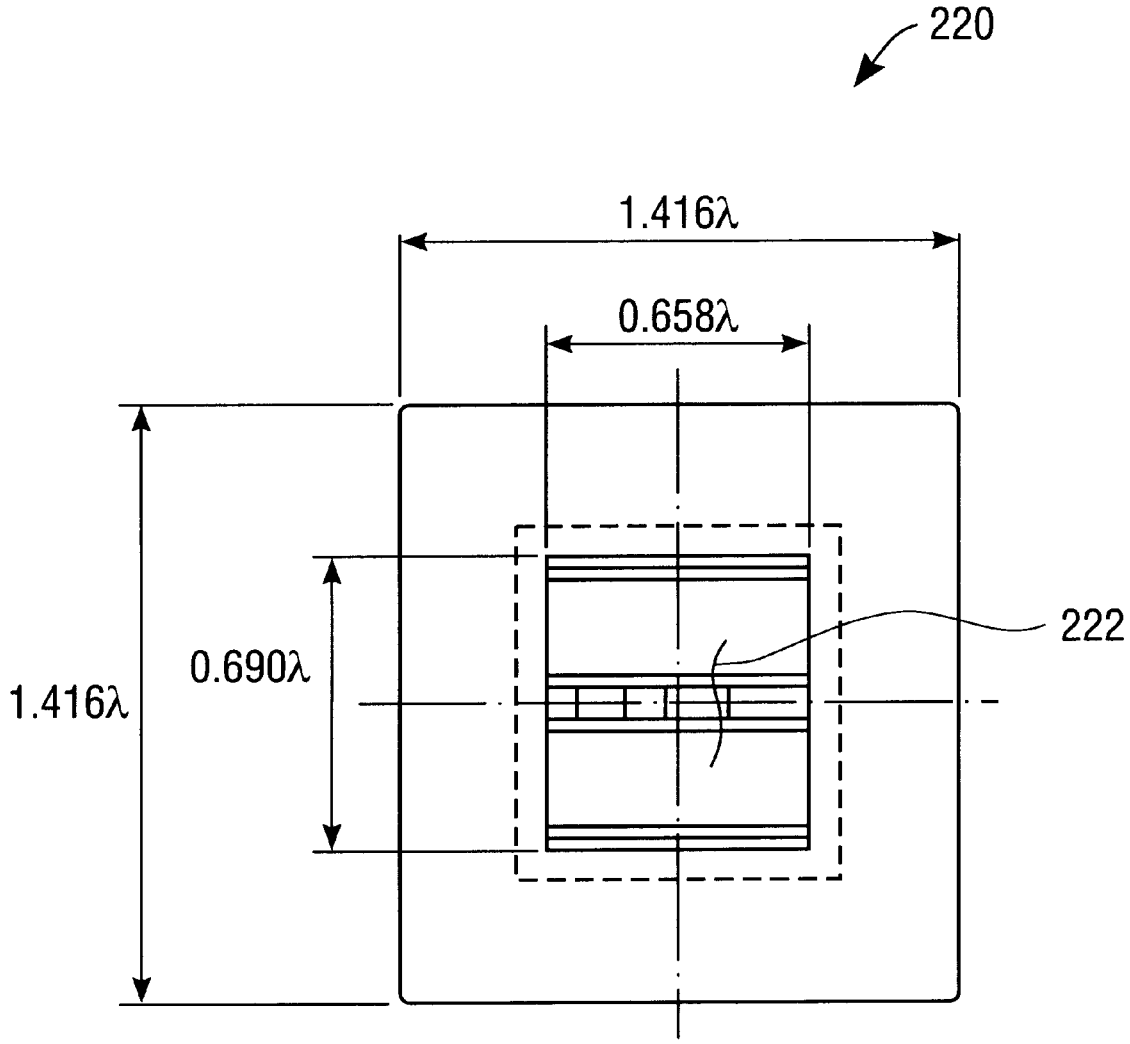

FIGS. 2C and 2D illustrate front and back views, respectively, of the waveguide polarizer 200 (both drawn substantially to scale). FIG. 2C illustrates the front view and shows the dual aperture waveguide 260. First and second orthogonal signal ports 264 and 266 are rectangular in shape having height and width dimensions of 0.219λ and 0.596λ, respectively. Common wall 268 is formed from the extension of septum 248 into the dual aperture waveguide 260, common wall having a thickness of 0.128λ. FIG. 2D illustrates the back view and shows the single aperture waveguide 220. Single aperture waveguide 220 has height and width dimensions of 0.690λ and 0.658λ, respectively.

The operation of waveguide polarizer 200 will now be described with reference to FIG. 2A operating as a receiver. Both LHCP and RHCP signals enter the single aperture waveguide 220. The received signals travel the length of the single aperture waveguide ($L_1$) and subsequently enter the septum-loaded waveguide 260 where the LHCP and RHCP signals impinge upon septum 248. Septum 248 separates and translates the RHCP and LHCP signals into two linearly polarized $TE_{10}$ modes that propagate through first and second waveguide channels 244 and 246. The $TE_{10}$ mode of the RHCP signal propagates through first waveguide channel 244, and the $TE_{10}$ mode of the LHCP signal propagates through second waveguide channel 246. First and second waveguide channels 244 and 246 transition into first and second signal ports 264 and 266 where septum 248 fully extends between side walls 202 and 204. RHCP and LHCP signals propagate along the first and second waveguide channels 244 and 246 and couple to first and second signal ports 264 and 266 when septum 248 fully extends between internal side walls 202 and 204. Probes may be placed at the output of first and second signal ports 264 and 266 to sense the presence of a RHCP signal or LHCP signal, respectively.

Figure 3A:
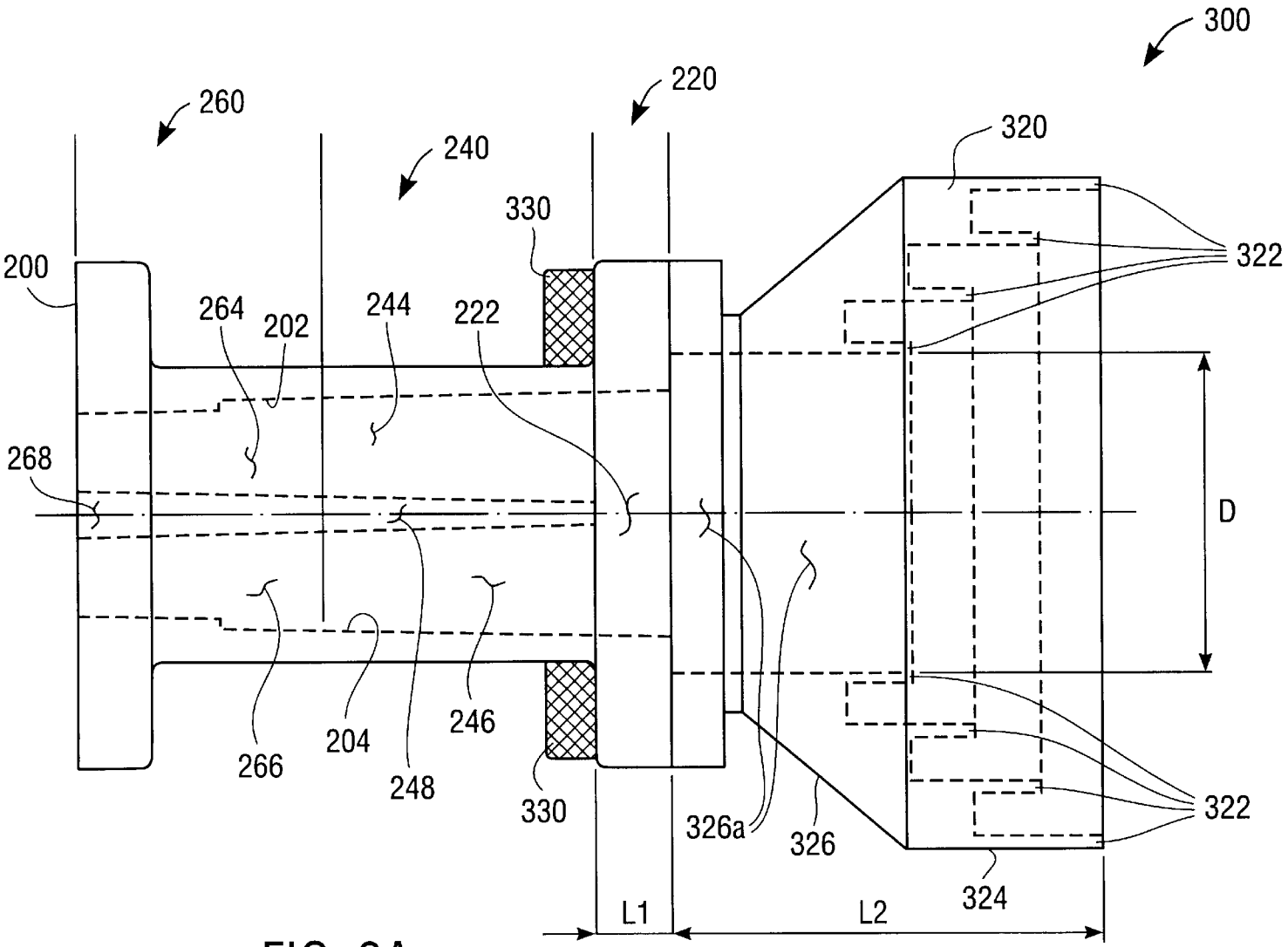
FIGS. 3A–C illustrate side, front, and rear views, respectively, of a waveguide antenna assembly in accordance with one embodiment of the invention.

FIG. 3A illustrates a side view of a waveguide antenna assembly 300 for communicating LHCP and RHCP signals over the Ka-Band frequency range (18–20 GHz) (drawn substantially to scaled). Those of skill in the art will appreciate that with obvious modifications the invention may alternatively be realized to operate over a different frequency range and/or signal polarization.

The assembly 300 includes a rectangular waveguide polarizer 200, described above, and a circular feedhorn 320. The circular feedhorn 320 includes a circular horn 324 for transmitting or receiving LHCP and RHCP signals and a conical feed 326 to couple signals to/from the waveguide polarizer 200. Circular horn 324 includes three corrugations 322 having inner diameters 28.38 mm, 23.56 mm, and 18.74 mm, and depths of 6 mm, 9 mm, and 12 mm, respectively. A larger or smaller number of corrugations having differing dimensions may be implemented in alternative embodiments. Conical feed 326 defines a cavity 326*a* having an inner diameter D of 14.19 mm. The circular feedhorn 320 has a total length $L_2$ of 20.5 mm. Other feedhorn geometries and dimensions may alternatively be employed. Screws 330 are used to secure the rectangular waveguide polarizer 200 to the circular feedhorn.

Figure 3B:
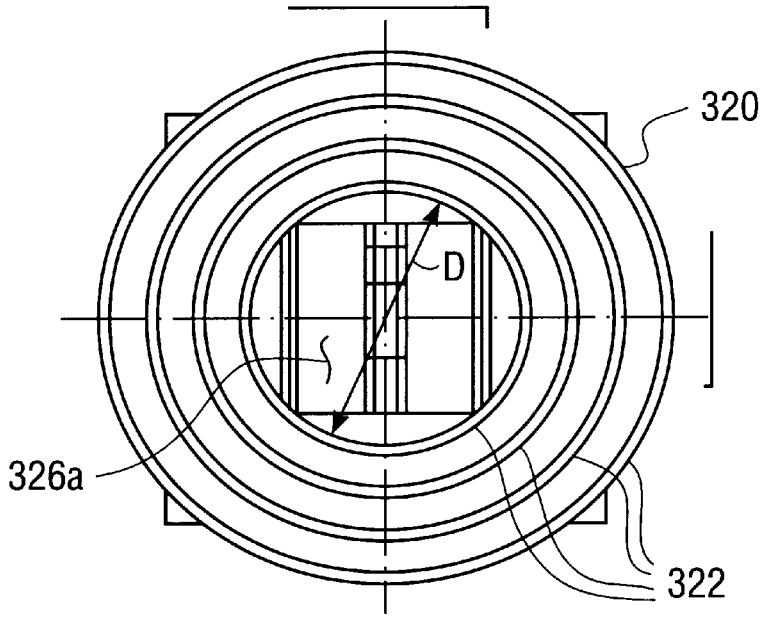
Figure 3C:
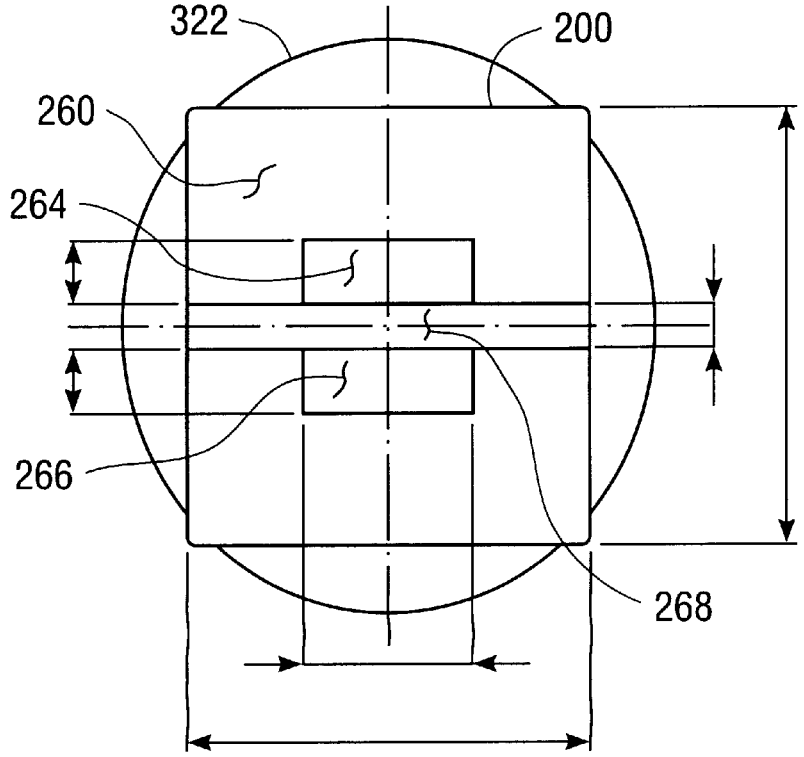

FIGS. 3B and 3C illustrate the front and rear views, respectively, of the waveguide antenna assembly 300. FIG. 3B illustrates the front view and shows the circular feedhorn 320. The circular feedhorn 320 includes corrugations 322 and a cavity 326*a* of inner diameter D. FIG. 3C illustrates the rear view and shows the waveguide polarizer 200. Waveguide polarizer 200 includes a dual aperture waveguide 260 having first and second orthogonal signal ports 264 and 266, respectively, separated by common wall 268.

If the waveguide polarizer 200 and the circular feedhorn 320 are connected improperly, the assembly will exhibit poor signal isolation between the first and second orthogonal signal ports 264 and 266. Poor isolation is caused by: (1) signal leakage occurring between the first and second waveguide channels 244 and 246, and (2) a portion of the transmitted signals being reflected at the polarizer-feedhorn interface and into the adjacent waveguide channel. During transmission, for instance, the first signal port 264 is excited, thereby creating a $TE_{10}$ mode signal in the first waveguide channel 244. As this signal propagates through the waveguide channel 244 toward the circular feedhorn, a portion of the signal leaks across the septum 248 into the second waveguide channel 246, and appears at the (second) orthogonal signal port 266 as a false LHCP signal. In addition, an impedance discontinuity at the polarizer-feedhorn interface operates to reflect a portion of the transmitted RHCP signal back into the waveguide polarizer 200. The reflected signal behaves as a received LHCP signal and propagates to the (second) orthogonal signal port 266 as another false LHCP signal. The leakage and reflected signals can combine to become a large false signal, requiring a higher threshold detection level and decreased antenna sensitivity.

Figure 4:
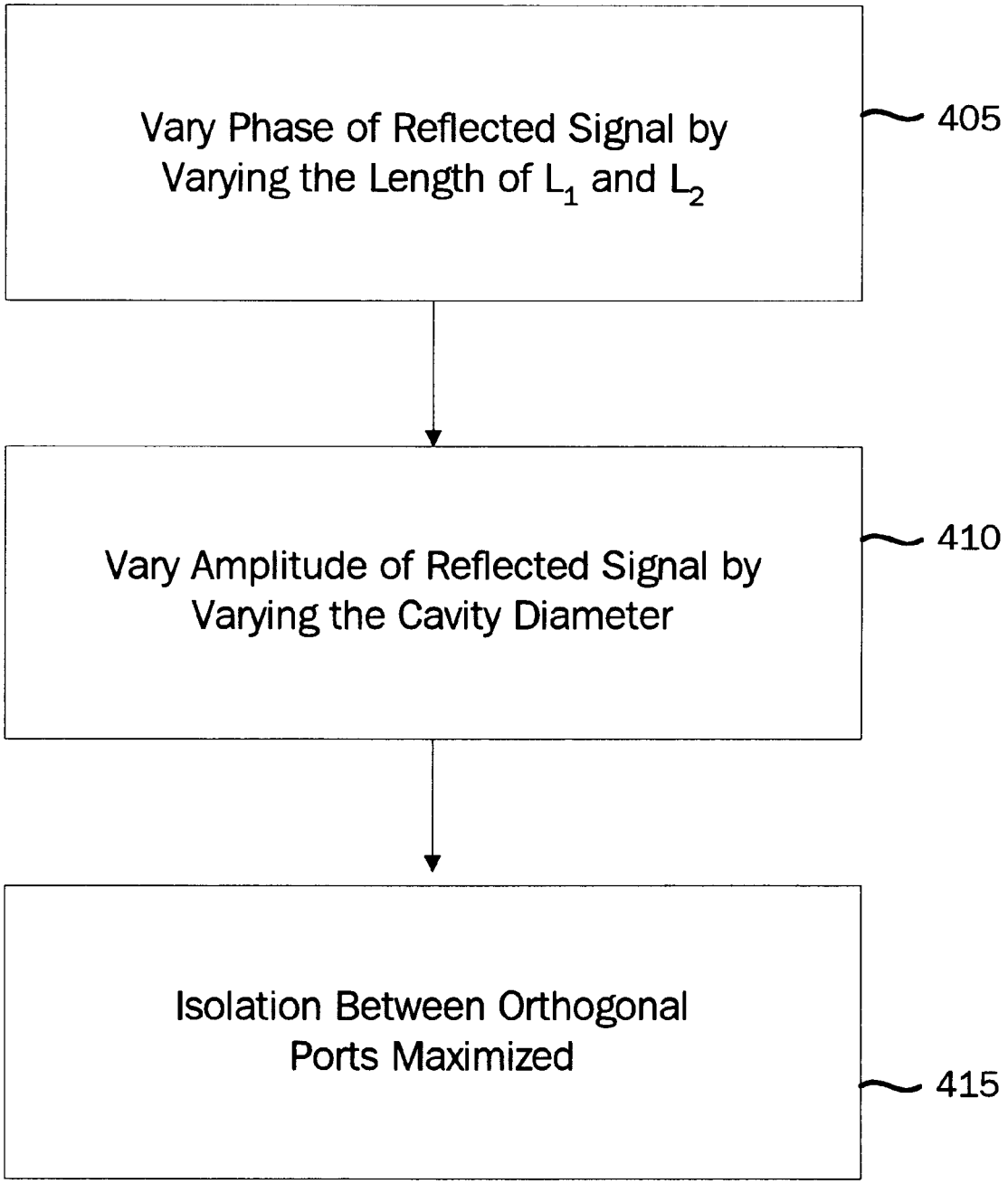
FIG. 4 illustrates a method for optimizing the isolation between orthogonal signal ports of a waveguide antenna assembly in accordance with one embodiment of the invention.

FIG. 4 shows a method for maximizing the isolation between the first and second orthogonal signal ports 264 and 266. Isolation is maximized by tuning the reflected signal to have the same amplitude and opposite phase compared to the leakage signal. When the leakage and reflected signals are subsequently combined at the isolated port, they effectively cancel each other, thereby providing a high degree of isolation. While the following description pertains to the circular feedhorn-rectangular waveguide polarizer antenna assembly described above, it is not limited thereto. The described process may also be employed to maximize isolation in other antenna assemblies having similar or dissimilar waveguide-feedhorn geometries.

Initially, the phase of the reflected signal is varied while the isolation between the first and second signal ports 264 and 266 is monitored. The phase of the reflected signal is varied by adjusting the lengths of one or both of the single aperture waveguide $L_1$ and the length of the circular feedhorn $L_2$. The phase is varied until the maximum isolation is measured, indicating that the reflected signal is approximately 180 degrees out of phase with the leakage signal.

Next, the amplitude of the reflected signal is varied until the isolation is further maximized. This is accomplished by varying (increasing or decreasing) the diameter D of cavity 326*a*. The variation in D causes the magnitude of the impedance discontinuity at the polarizer-feedhorn interface to increase or decrease, which in turn increases or decreases the amplitude of the reflected signal. D is varied until a maximum isolation measurement is achieved, indicating that the reflected signal has approximately the same amplitude as the leakage signal. The aforementioned isolation measurements can be made using, for instance, a S-Parameter test set or other similar test components having the capability of measuring signal amplitude and phase over the desired frequency range.

The invention has now been explained with reference to specific embodiments. It is therefore not intended that this invention be limited except as indicated by the appended claims and their full scope of equivalents.

What is claimed is:

1. A waveguide polarizer comprising:

a single aperture waveguide having a first waveguide port and a second waveguide port;

a septum-loaded waveguide having a first waveguide port coupled to said single aperture waveguide second port, a second waveguide port, and a septum disposed therein; and a dual aperture waveguide having a first waveguide port coupled to said septum-loaded waveguide second port and a second waveguide port;

wherein said septum has a varying thickness dimension.

2. The waveguide polarizer of claim 1, wherein said septum's varying thickness dimension comprises a minimum septum thickness proximate to said single aperture waveguide second port and a maximum septum thickness proximate to said dual aperture waveguide first port.

3. The waveguide polarizer of claim 2, wherein said varying septum thickness dimension comprises substantially a 2 degree taper.

4. The waveguide polarizer of claim 1, wherein said septum-loaded waveguide is formed from at least one internal wall having a varying thickness dimension.

5. The waveguide polarizer of claim 4, wherein said single aperture waveguide and said dual aperture waveguide are formed from said at least one internal wall.

6. The waveguide polarizer of claim 5, wherein said at least one internal wall comprises:

internal top and bottom walls extending between said single aperture waveguide first port and said dual aperture waveguide second port;

internal side walls connected to said internal top and bottom walls and extending between said single aperture waveguide first port and said dual aperture waveguide second port.

7. The waveguide polarizer of claim 6, wherein said dual aperture waveguide further comprises a first waveguide step formed on said internal top wall, and a second waveguide step formed on said internal bottom wall.

8. The waveguide polarizer of claim 7 wherein said internal top, bottom, and side walls have a minimum thickness proximate to said single aperture waveguide first port and a maximum thickness proximate to said dual aperture waveguide second port.

9. The waveguide polarizer of claim 8, wherein said varying internal wall thickness dimension comprises substantially a 2 degree taper.

10. A waveguide antenna assembly for communicating waveguide signals comprising:

a circular feedhorn having a first port and a second port; and a waveguide polarizer coupled to said circular feedhorn second port, said waveguide polarizer comprising:

a single aperture waveguide having a first waveguide port coupled to said circular feedhorn second port and a second waveguide port;

a septum-loaded waveguide having a first waveguide port coupled to said single aperture waveguide second port, a second waveguide port, and a septum disposed therein; and a dual aperture waveguide having a first waveguide port coupled to said septum-loaded waveguide second port and a second waveguide port;

said septum-loaded waveguide formed from at least one internal wall having a varying thickness dimension; and said septum has a varying thickness dimension.

11. The waveguide antenna assembly of claim 10, wherein said at least one internal wall has a minimum thickness proximate to said single aperture waveguide second port and a maximum thickness proximate to said dual aperture waveguide first port.

12. The waveguide antenna assembly of claim 11, wherein said single aperture waveguide and said dual aperture waveguide are formed from said at least one internal wall, wherein said at least one internal wall comprises:

internal top and bottom walls extending between said single aperture waveguide first port and said dual aperture waveguide second port;

internal side walls connected to said internal top and bottom walls and extending between said single aperture waveguide first port and said dual aperture waveguide second port, and wherein said internal top, bottom, and side walls each have a minimum thickness proximate to said single aperture waveguide first port and a maximum thickness proximate to said dual aperture waveguide second port.

13. The waveguide polarizer of claim 12, wherein said dual aperture waveguide further comprises a first waveguide step formed on said internal top wall, and a second waveguide step formed on said internal bottom wall.

14. In a waveguide antenna assembly having a feedhorn coupled to a waveguide polarizer for communicating orthogonal signals, the feedhorn having a total length $L_2$ and a cavity aperture coupled to the waveguide polarizer, the waveguide polarizer including a dual aperture waveguide having first and second orthogonal signal ports of sensing or launching orthogonal signals, a septum-loaded waveguide coupled thereto, and a single aperture waveguide of length $L_1$ coupled to the circular feedhorn, a method for maximizing signal isolation between the first and second orthogonal signal ports, the method comprising:

varying said lengths $L_1$ and $L_2$ until said signal isolation is maximized; and varying the dimension of said cavity aperture until said signal isolation is further maximized.

* * * * *